US008324492B2

(12) United States Patent
Feeney et al.

(10) Patent No.: US 8,324,492 B2
(45) Date of Patent: Dec. 4, 2012

(54) MUSICALLY INTERACTING DEVICES

(75) Inventors: Robert J. Feeney, Glendale, CA (US); Jeff E. Haas, Glendale, CA (US); Brent W. Barkley, Glendale, CA (US)

(73) Assignee: Vergence Entertainment LLC, Glendale, CA (US)

( * ) Notice: Subject to any disclaimer, the term of this patent is extended or adjusted under 35 U.S.C. 154(b) by 1196 days.

(21) Appl. No.: 11/738,433

(22) Filed: Apr. 20, 2007

(65) Prior Publication Data

US 2007/0256547 A1 Nov. 8, 2007

Related U.S. Application Data

(60) Provisional application No. 60/745,306, filed on Apr. 21, 2006.

(51) Int. Cl.
*G10H 1/18* (2006.01)

(52) U.S. Cl. ..... 84/615; 84/1; 84/600; 84/601; 84/602; 446/175; 446/297; 446/303

(58) Field of Classification Search ..... 84/615, 84/1, 600, 601, 602; 446/175, 297, 303
See application file for complete search history.

(56) References Cited

U.S. PATENT DOCUMENTS 4,169,335 A * 10/1979 Betancourt ..... 446/297
4,857,030 A 8/1989 Rose
4,938,483 A 7/1990 Yavetz
4,949,327 A * 8/1990 Forsse et al. ..... 369/53.31
5,438,154 A * 8/1995 Segan et al. ..... 84/600
6,089,942 A 7/2000 Chan
6,177,626 B1 * 1/2001 Ishibashi ..... 84/635
6,560,511 B1 * 5/2003 Yokoo et al. ..... 700/245
6,641,454 B2 11/2003 Fong et al.
6,729,934 B1 5/2004 Driscoll et al.
6,735,430 B1 * 5/2004 Farley et al. ..... 455/414.1
6,822,154 B1 * 11/2004 Thai ..... 84/609
7,025,657 B2 * 4/2006 Nishimoto ..... 446/484

(Continued)

FOREIGN PATENT DOCUMENTS

WO WO-A 0170361 9/2001

(Continued)

OTHER PUBLICATIONS

International Search Report and Written Opinion of the International Searching Authority in corresponding PCT application serial No. PCT/US2007/067161, mailed Apr. 9, 2008.

*Primary Examiner* — Kawing Chan
(74) *Attorney, Agent, or Firm* — Joseph G. Swan, P.C.

(57) ABSTRACT

Provided is, among other things, a system of musically interacting devices. A first device has a first identification code, a first wireless communication interface and a first audio player, and a second device has a second identification code, a second wireless communication interface and a second audio player. The first device and the second device are configured to participate in an interaction sequence in which: the first device wirelessly communicates using the first wireless communication interface, the second device wirelessly communicates using the second wireless communication interface, a musical composition is selected based on both the first identification code and the second identification code, and the first device and the second device cooperatively play the musical composition, with each of the first device and the second device playing a different part of the musical composition.

17 Claims, 11 Drawing Sheets

U.S. PATENT DOCUMENTS

| | | | | |
|---|---|---|---|---|
| 7,037,166 | B2 * | 5/2006 | Shrock et al. | 446/175 |
| 7,068,941 | B2 * | 6/2006 | Fong et al. | 398/107 |
| 2004/0038620 | A1 * | 2/2004 | Small et al. | 446/491 |
| 2004/0069122 | A1 | 4/2004 | Wilson | |
| 2004/0259465 | A1 | 12/2004 | Wright et al. | |
| 2005/0140185 | A1 * | 6/2005 | McClintock et al. | 297/136 |
| 2006/0162533 | A1 * | 7/2006 | Grossman | 84/600 |

FOREIGN PATENT DOCUMENTS

| | | |
|---|---|---|
| WO | WO 01/86625 | 11/2001 |

* cited by examiner

MUSICALLY INTERACTING DEVICES

This application claims the benefit of U.S. Provisional Patent Application Ser. No. 60/745,306, filed on Apr. 21, 2006, and titled "Interactive Animation Toy", which application is incorporated by reference herein as though set forth herein in full.

FIELD OF THE INVENTION

The present invention pertains to systems, methods and techniques that involve a number of devices, such as toys, that musically interact with each other.

SUMMARY OF THE INVENTION

One set of embodiments of the present the invention is directed to a system of musically interacting devices (such as devices configured to resemble character toys). A first device has a first identification code, a first wireless communication interface and a first audio player, and a second device has a second identification code, a second wireless communication interface and a second audio player. The first device and the second device are configured to participate in an interaction sequence in which: the first device wirelessly communicates using the first wireless communication interface, the second device wirelessly communicates using the second wireless communication interface, a musical composition is selected based on both the first identification code and the second identification code, and the first device and the second device cooperatively play the musical composition, with each of the first device and the second device playing a different part of the musical composition.

Another set of embodiments is directed to a system of musically interacting devices, in which a first device has a stored first library of musical segments according to a first musical style, a first wireless communication interface and a first audio player, and a second device has a stored second library of musical segments according to a second musical style, a second wireless communication interface and a second audio player. The first device and the second device are configured to participate in an interaction sequence in which: the first device wirelessly communicates using the first wireless communication interface and the second device wirelessly communicates using the second wireless communication interface, a musical composition is selected based on the first musical style, the first device plays the musical composition, and the second device plays accompanying music to the musical composition, the accompanying music being based on the second musical style and either or both of: (1) the first musical style (i.e., the style of the first device), and (2) the musical composition that the first device is playing.

A still further set of embodiments is directed to a system of musically interacting devices, made up of a plurality of different devices, each having an associated identification code and each storing a plurality of musical patterns related to its identification code. Upon linking individual ones of the different devices together, the linked devices execute an interaction sequence in which they play a musical composition, with different ones of the linked devices playing different parts of the musical composition, where the musical composition is based on the associated identification codes of the linked devices.

The foregoing combinations of features correspond to particular categories of embodiments of the present invention. However, the present invention includes a variety of different features, and those features may be combined in any desired manner in the various embodiments of the invention. Examples of such features are mentioned briefly below.

One aspect of the invention is the ability for individual devices to interact musically. For example, in one embodiment with any given pair of devices (e.g., toys), both are pre-programmed with 8 bars of a tune which, when played together in sequence, constitute harmony and melody. In another embodiment, the 8 bars are shuffled randomly and can be played out of sequence; when two such shuffled sequences are played together, they constitute a harmony and a melody; this preferably is accomplished by composing the music with a very simple use of chords.

According to another aspect, a device can be programmed to poll for a compatible device at random times. If one or more such devices are found, then all of the devices preferably engage in a harmony/melody tune, without the prompting of a human. For example, at random times, each such device (preferably configured as a toy) "awakens" and makes a sound as if calling out for a friend. If it does not detect a friend nearby, it may sing/play a melancholy song; on the other hand, if it detects and engages one or more other toys, they play/sing the tunes that relate to their relationship.

In another aspect, content in the individual devices can be refreshed by digital download via USB (universal serial bus) port, via optical or infrared data exchange (e.g., when exposed to a display screen), or by interchangeable modules. Such modules may be implemented as different hats, plumes or other toy accessories, which provide the toy a different or modified identity, and/or which include a library of additional musical segments. Each such module preferably carries a chip or device that triggers a different tune or library of tunes to be played which indicate its new or modified identity, e.g., a cowboy hat triggers a library of country tunes, or dreadlocks trigger a library of reggae tunes. Refreshing content in any of the foregoing ways also can reflect aging of the toy character, or levels of education of the toy character.

According to still further aspect, each device has a unique identity and therefore plays/sings a unique style of music, e.g., rock, jazz, classical, country-western, etc., or music from a particular nation, e.g., Latin, Russian, Japanese, African, US, Arabic, etc. When played alone, each device preferably plays a "pure" version of its identifying style. When two or more devices play together, they preferably each express a similar but modified version of their identifying style which harmonizes and coordinates well with the other(s), creating unique musical "fusion" styles.

According to still further aspect, when two or more devices play together, their volume increases or decreases depending on their proximity to each other. If further away, the volume increases, as if calling out to each other; and the volume decreases when they are closer. This feature often can effectively improve the blend of harmony and melody, and create a more realistic spatial dynamic between the toys.

According to still further aspect, a device according to the present invention is provided with can have an alarm-clock feature. When it "awakens", it engages other toys in its midst to play/sing in harmony.

According to still further aspect, devices according to the present invention are programmed to play seasonal music—e.g., birthday, Christmas, Hanukah, etc., e.g., either as a timer embedded in the device, where the timer identifies the date and plays the pre-stored seasonal song(s) in the pre-programmed timeframe as soon as the user activates the device and/or the song is downloaded or applied to the toy by interchangeable module on that day.

According to still further aspect, devices according to the present invention react to a recording (or other previously generated programming content) played on any audio or audiovisual medium. For example, a device (e.g., implemented as a toy) is pre-programmed to play/sing in harmony with a video recording of a character played on a television program or portrayed on a website. In another example, the device is pre-programmed to speak in a timed dialogue scene with programming content (e.g., audio and/or video) downloaded to and played on a portable digital media player. In another example, the device is pre-programmed to sing, play or speak in timed harmony or sequence with a compatible device or with a recording transmitted by phone, Internet or other communication link. For example, such a device might recognize a melody played on any MP3 player, a tape, a CD or radio and can sing or play along. The melody pattern preferably matches a melody they have in their library of songs programmed into the device.

According to still further aspect, a device according to the present invention interacts with another device over live Internet streaming video or Internet telephony, via voice/sound recognition or by connecting the devices at both ends of the transmission (e.g., to a general-purpose computer that is managing the communication), using a USB, Bluetooth or other hard-wired or wireless connection.

According to still further aspect, a device according to the present invention can record live sounds, modify and then replay them in a different manner or pattern. For example, the user can record his voice on the device, and the device is programmed to replay the user's speech using a modified speech pattern, using a modified musical pattern or even in a different sequence (e.g., backward). Other features can include scrambling segments of the recording; using a sample of the speech recording and applying it repeatedly to a rhythm or music track, etc.

According to still further aspect, a device according to the present invention functions as a playback device, allowing a user to scan through recordings on the device and select the ones that he or she wants to play back.

According to still further aspect, devices according to the present invention can be activated in sequence, in which case the first device activated begins a song, then a second device is activated and joins the first at a point in the middle of the song, and then a third device is activated and it joins in the song, all in "synch" with the others. Such an approach preferably can be used with any number of different devices.

According to still further aspect, devices according to the present invention not only play music together when they recognize one another, but can also dance or converse, where one takes an action and then the other and then the first again, alternating their exchange like a conversation, e.g., cued by a wireless connection.

According to still further aspect, a device according to the present invention interfaces with a book, e.g., so that as the page is turned, the device recognizes it and sings, dances, converses or "reads" accordingly.

The foregoing summary is intended merely to provide a brief description of certain aspects of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 1:
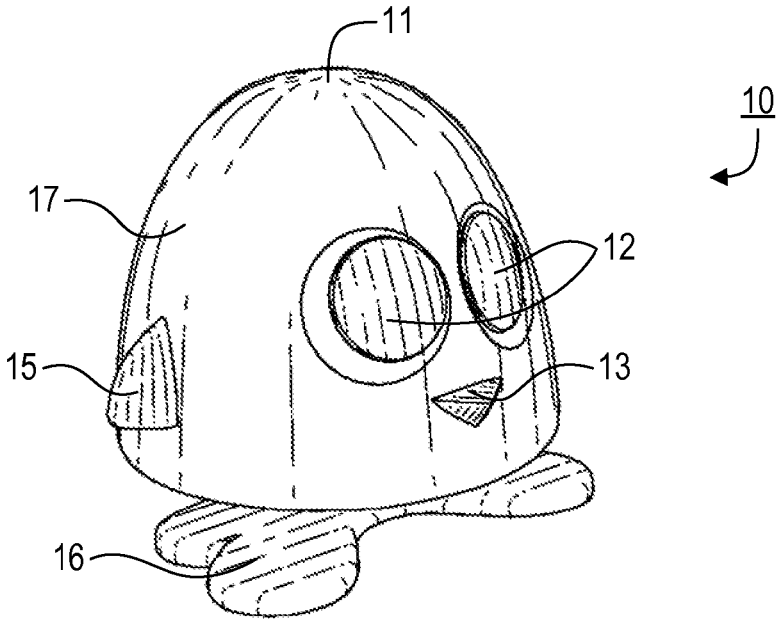
FIG. 1 illustrates a perspective view of a device implemented as a character toy according to a representative embodiment of the present invention.
Figure 2:
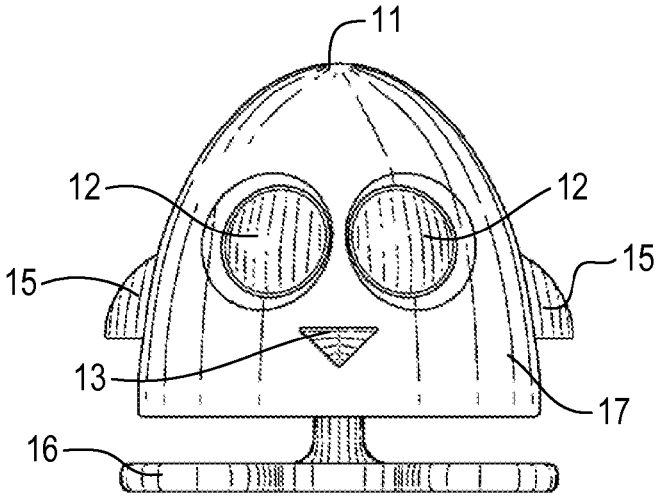
FIG. 2 illustrates a front elevational view of a device implemented as a character toy according to a representative embodiment of the present invention.

The present invention is directed to devices and, generally speaking, to devices that interact with other similar devices. In the preferred embodiments, a device according to the present invention is configured to represent a character toy, e.g., a toy that resembles a human being, an animal or a fictional character. An example is toy character 10 shown in FIGS. 1 and 2. As shown, the device 10 has the outward appearance of a fictionalized bird character, with eyes 12 a nose 13, wings 15, feet 16 and a composite head/body 17.

In certain embodiments, device 10 includes a number of user interfaces. For example, the entire head/body 17 and each of wings 15 preferably functions as a switch for providing real-time input to device 10. That is, the head/body 17 may be pressed downwardly and each of the wings 15 may be pressed inwardly to achieve a desired function. More preferably, the particular function of each of head/body 17 and wings 15 depends upon the immediate context and also is programmable or configurable by the user (e.g., through an external interface). For example, depressing head/body 17 when device 10 is in the sleep mode might awaken it while depressing head/body 17 when device 10 is in the awake mode might put it back to sleep. Alternatively, by appropriately selecting the functions for the provided switches, either one of the wings 15 might be made to function in this manner. In the same way, any of the provided switches may be configured to change the volume, song selection, musical play pattern (e.g., corresponding to different musical instruments) or to fast-forward or rewind through an individual song. Still further, a single switch preferably can be configured to perform multiple functions by operating it differently. For example, quickly depressing and releasing one of these switches might cause a skip to the next song, while holding the same switch down continuously might fast-forward through the song or, alternatively, increase the playback speed, for the entire duration of the time that the switch is depressed.

In addition to input interfaces, various aspects of the design 10 may be used for output purposes. For example, eyes 12 may be provided with a grid or other arrangement of light-committing diodes (LEDs) which can be illuminated in different patterns depending upon the particular circumstances. For example, when the bird 10 is in love, such LEDs might be made to illuminate in the pattern of a heart.

Similarly, the toy 10 may be provided with a plume (or hairstyle) that is made from fiber-optic strands that can be made to illuminate individually or in patterns. As with the eyes 12, such fiber-optic patterns preferably can be made to illuminate in different patterns to reflect different circumstances.

Still further, device 10 may be provided with one or more small internal electric motors that permit its wings 15 and/or feet 16 to move. As a result, the device 10 may be programmed to walk or even dance, e.g., in synchronization with the music it and/or other (e.g., similarly configured) devices is/are playing.

It should be understood that toy 10 is merely exemplary, and any other toy character instead may be used. In addition, a device according to the present invention is not required to have any particular outward appearance, and in certain cases will be indistinguishable at an initial glance from other electronic devices. Moreover, a device according to the present invention may be implemented as part of an existing device, such as by incorporating any of the functionality described herein into a media playing device (e.g., a MP3 player) or into a communication device (e.g., a wireless telephone). In the preferred embodiments, a device according to the present invention is relatively small (e.g., having a maximum dimension of no more than 6-8 inches and, more preferably, no more than 4-5 inches).

Figure 3:
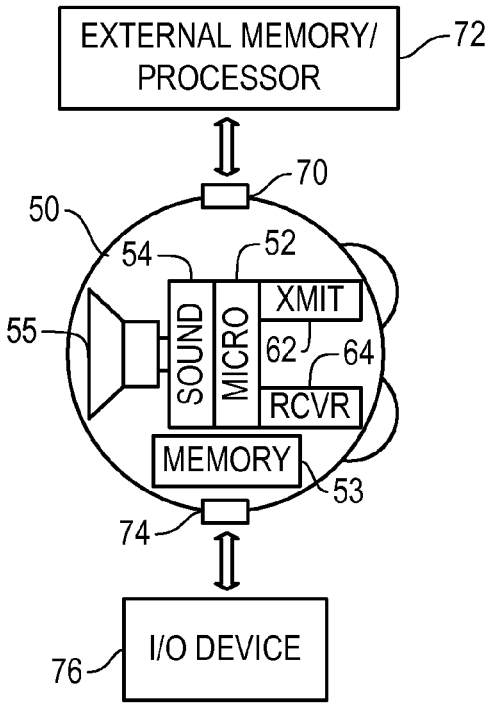
FIG. 3 illustrates a block diagram of certain components of a device according to a representative embodiment of the present invention.

FIG. 3 illustrates a block diagram of certain components of a device 50 according to a representative embodiment of the present invention. Included in device 50 is a processor 52 that retrieves computer-executable process steps and data out of memory 53, and executes such steps in order to process the retrieved data. Attached to processor 52 is a sound or audio chip or card 54 that plays musical segments through a speaker or other audio output interface 55, typically by retrieving a variety of digital musical segments out of memory 53, as instructed by processor 52, converting them into an analog audio signals and then amplifying the analog audio signals to drive the speaker or other audio-output device 55.

A wireless transmitter 62 and receiver 64 permits device 50 to communicate with other similar devices and/or, in certain embodiments, with devices that have significantly different functionality and/or capabilities. In the various embodiments, transmitter 62 and receiver 64 use any of the known wireless transmission technologies, e.g., infrared, Bluetooth, any of the 802.11 technologies, any other low-power short-range wireless method of communication, or any other radio, optical or other electromagnetic communication technology to establish contact and transfer commands or data between devices. The data transfer between any two devices or from any device transmitting data to more than one other device in the vicinity could be half-duplex or full duplex based on the transmission and receiver technology deployed.

In addition, device 50 optionally is provided with a hardware port 70 for allowing an external device 72 (such as a small, portable and interchangeable module) to be attached to device 50. Such a device 72 can include memory (e.g., preloaded with a library of musical segments and/or configuration data) and/or a processor for performing additional tasks or for offloading tasks that otherwise would be performed by processor 52.

Device 50 optionally also is provided with a separate communication port 74 that expands the ability of device 50 to communicate with other input/output devices 76, particularly laptop, desktop or other general-purpose computers or other hard-wired or wireless network-capable devices or appliances. Thus, for example, if wireless transmitter 62 and receiver 64 use Bluetooth technology, then communication port 74 may be configured as a USB or FireWire port.

Figure 4:
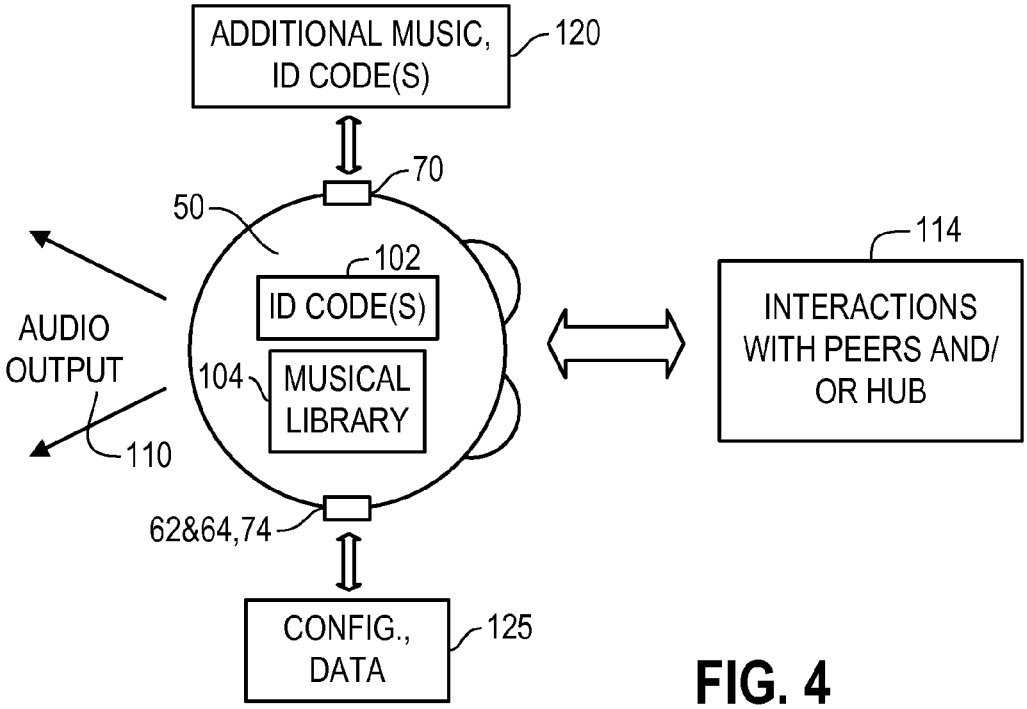
FIG. 4 illustrates a conceptual view of a device according to a representative embodiment of the present invention.

FIG. 4 illustrates a conceptual view of device 50 according to a representative embodiment of the present invention. In this embodiment, device 50 stores one or more identification codes 102, together with a library 104 of musical segments (which might be entire musical compositions or parts thereof). As discussed in more detail below, the identification code(s) 102 preferably influence (at least in part) the particular music that is played by device 50 from library 104 and/or the ways in which such music is played, resulting in output music 110 (e.g., played through speaker 55 using audio chip 54). In addition, the identification code(s) 102 preferably also influence the interactions 114 with other devices. In the preferred embodiments, the identification codes 102 generally correspond to the personality or style of the device 50, at least from a musical standpoint.

Also in the preferred embodiments, the device 50 behaves differently in different circumstances, e.g., by providing dynamic responses that vary based on setting and time. As described in more detail below, one source for influencing the behavior of device 50 on a particular occasion are the interactions 114 that device 50 has with other devices (e.g., other devices configured similarly to device 50). Such interactions 114 can occur, e.g., via wireless transmitter 62 and receiver 64, and preferably influence not only immediate responses, but also long-term responses of device 50.

Another potential source for influencing such behavior is the ability to temporarily attach a module (e.g., module 72) through port 70. In the preferred embodiments, such a module 72 stores information 120 that includes additional musical segments and/or identification codes, and can be easily attached, detached and/or replaced with a different module, as and when desired. More preferably, each such module 72 corresponds to a different musical style or quality, and is configured with an outward appearance that matches such style. For example, with respect to device 50 (shown in FIGS. 1 and 2), port 70 might be located at the top 11 of the bird's head; in such a case, different plumes, hairstyles, hats or other headwear preferably correspond to different musical styles (e.g., a cowboy hat corresponding to country music or a dreadlock hairstyle corresponding to reggae).

In addition, in certain embodiments of the invention data 125 can be downloaded into device 50, e.g., through port 74 and/or through wireless transmitter 62 and receiver 64. Depending upon the particular embodiment, such data 125 preferably include configuration data (e.g., allowing the user to change some aspect of the device's personality or its entire personality and/or additional software for implementing new functionality) and/or other kinds of data (e.g., additional or replacement musical segments or any other kind of the external data and related to the environment in which the device that is located).

Figure 5:
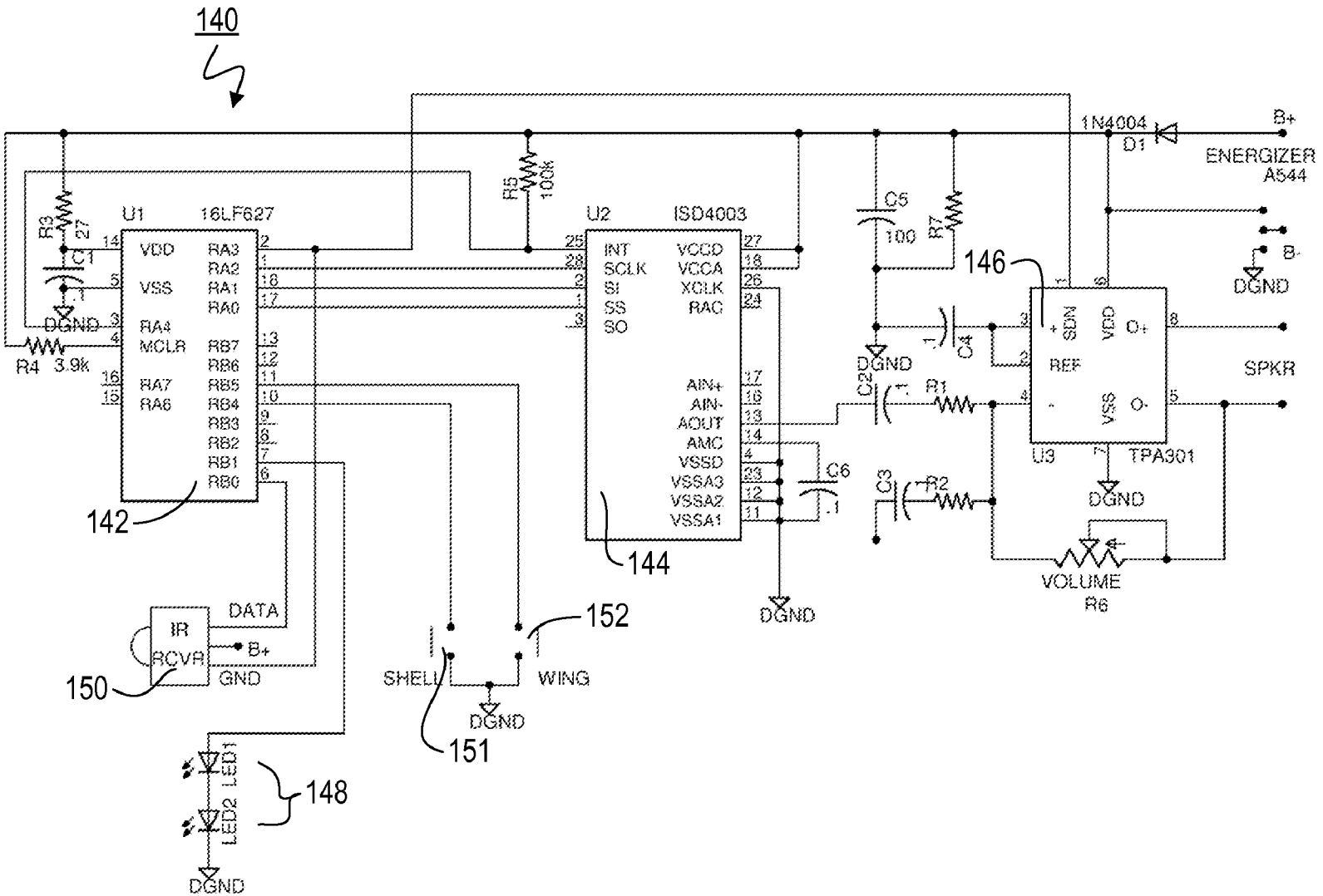
FIG. 5 illustrates a schematic diagram of a device according to a representative embodiment of the present invention.

FIG. 5 illustrates a schematic diagram for the electronic circuitry 140 of a device 50 according to a representative embodiment of the present invention. In circuit 140, a low-cost 16-bit reduced instruction set computer (RISC) microcontroller 142 (e.g., Microchip's 16LF627) manages all the intercommunication to other devices using infrared (IR) and also initiates the device 50's audio through audio record/playback chip 144 (e.g., Winbond Electronics Corp.'s ISD4002 ChipCorder® having on-chip oscillator, anti-aliasing filter, smoothing filter, AutoMute®, audio amplifier, and high-density multilevel flash memory array).

Wireless communication is performed using half-duplex IR packet messaging so that device 50 can transmit or receive command or data from nearby units. The received commands and/or data are then used by a software program executing in the microcontroller 142 to configure the record/playback chip 144 to play pre-recorded audio content.

The record/playback chip 144 used in the present embodiment currently is available with a capacity of between 4-8 minutes of recording. In alternate embodiments where greater capacity is desired, other configurations can be used (e.g., using separate flash memory) to increase this capacity.

The microcontroller 142 initiates a certain pre-recorded song to be played by initializing the record/playback chip 144 and providing the address from which the pre-recorded song should begin. The microcontroller 142 is interrupted at the end of the music or song sequence, at which time, based on the specific software program executing in the microcontroller 142, e.g., the prerecorded song can be played again or the device 50 is placed into the sleep mode.

Audio power amplifier 146 (e.g., Texas Instruments TPA301) amplifies the analog audio from record/playback chip 144 to drive the speaker 55. The chain of light-emitting diodes (LEDs) 148 is used by the microcontroller 142 to broadcast command data to other devices 50 when switched ON. IR receiver 150 receives IR transmissions from other devices 50, and the received serial data are than transfer to the microcontroller 142 to be processed. Based on the data or commands received, the microcontroller 142 initiates the appropriate action, e.g., initializing the record/playback chip 144 and playing a certain pre-recorded tune from a known location/address within record/playback chip 144.

Pushbutton switch 151 is the switch that is activated when the shell 17 is depressed and pushbutton switch 152 is the switch that is activated when one of the wings 15 is pressed inwardly. Switches 151 and 152 are simple ON/OFF command switches to the microcontroller 142 that force certain jumps within the program executing on the microcontroller 142. As such, the functions they provide are entirely configurable in software.

Figure 6:
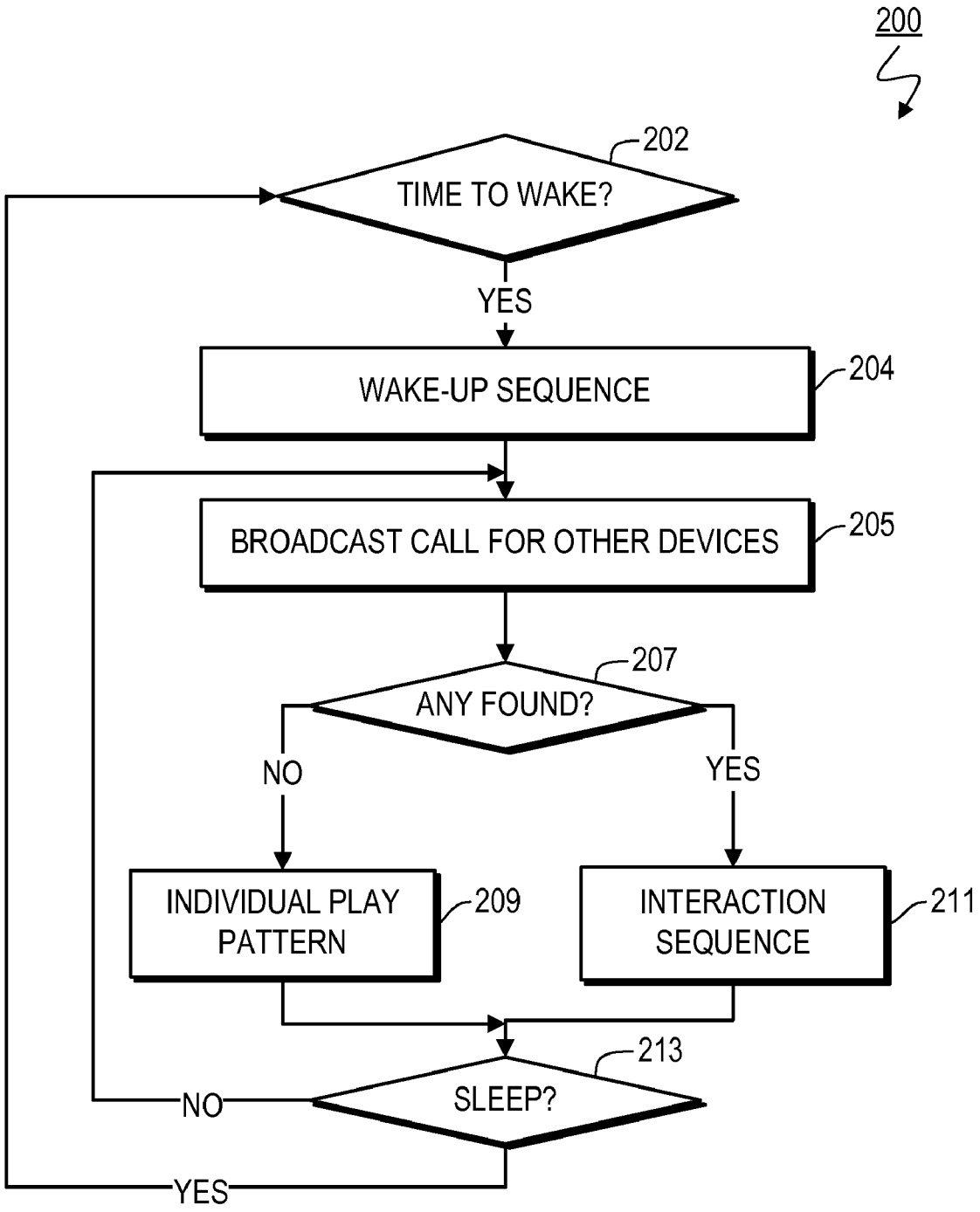
FIG. 6 is a flow diagram illustrating the overall behavior pattern of a device according to a representative embodiment of the present invention.

FIG. 6 is a flow diagram illustrating the overall behavior pattern 200 of a device 50 according to a representative embodiment of the present invention. Ordinarily, process 200 is implemented entirely in software, but in alternate embodiments is implemented in any of the other ways described herein.

Initially, in step 202 a determination is made as to whether the device 50 should awaken. Any of several different criteria may be used to make this determination. In one example, the device 50 automatically wakes up at periodic time intervals (e.g., every hour). In another example, the device 50 wakes up at random times. In a still further example, device 50 only wakes up when instructed to do so by the user (e.g., with respect to device 10, by pressing one of the wings 15). In still further examples, any combination of the foregoing techniques may be used to awaken device 50. If it is in fact time for the device 50 to awaken, then processing proceeds to step 204. If not, then step 202 is repeated periodically or continuously until it is time to awaken.

In step 204, the device 50 awakens. At this point, it might play a musical song or provide some other audio output 110 to indicate that it has awoken. In one representative embodiment, the same tune is played every time the device 50 awakens. In another embodiment, the audio output 110 depends upon the identification codes 102. As indicated above, the identification codes 102 preferably correspond to the experience, personality and/or musical style of the device 50. Accordingly, a tune may be selected (either in whole or by selecting from different musical segments) from within library 104 using a random selection based on the musical style indicated by identification codes 102. In an alternate embodiment, at least one of the identification codes 102 corresponds to present mood, which also may vary randomly (in whole or in part) each time the device 50 awakens; in such an embodiment, the song selected or assembled is based on the present mood code. Still further, in addition to, or instead of, audio output 110, the device 50 may also provide other output, such as by dancing, by illuminating its eyes in particular patterns, or the like.

In step 205, upon completion of any wake-up sequence 204, device 50 broadcasts a call for other related or compatible devices. In the preferred embodiments of the invention, this broadcast is made via its wireless transmitter 62 and also is made using an audio call pattern. For example, with respect to the stylized bird 10 shown in FIGS. 1 and 2, a unique chirping pattern may be produced while the wireless transmission is broadcast. Preferably, any such related or compatible devices continuously monitors for (at least during its waking time), and is configured to respond to, either such signal. Ordinarily, the wireless signal will be the easiest to detect. However, in certain circumstances of the wireless signal might be blocked while the audio signal is capable of reaching the other device.

In addition, configuring the various compatible devices to respond to audio cues as well as electromagnetic ones has the added benefit of making the devices seen more natural. For example, a device might respond audibly to a sound that resembles the unique chirping pattern. Also, enabling responses to audio cues can provide for an additional type of user interaction, i.e., where the user tries to imitate the chirping pattern him or herself to obtain a reaction from the device 50.

It is noted that in alternate embodiments and/or in alternate circumstances with respect to the same embodiment, only one or the other types of cues is utilized. For example, if one of the devices 50 already is engaged in playing a musical composition, than communicating with audio cues generally would be difficult or impossible, so in that case communication might be restricted to wireless broadcasts.

Regardless of the specific medium for communication, two devices preferably execute a predetermined interaction sequence to confirm that they have in fact identified each other. One aspect of this interaction sequence preferably is the exchange of at least some of the identification codes for the two devices.

If no other device responds or is able to confirm, then processing proceeds to step 209. However, if a device is found and confirmed, then processing proceeds to step 211.

In step 209, an individual play pattern is executed. Preferably, this play pattern is influenced by the circumstances (failure to find another device, e.g., a friend) as well as the individual identification codes 102 for the particular device 50. As noted above, in certain embodiments one of such codes 102 is a mood code. Thus, if the device 50 wakes in a lonely mood and fails to find a friend, it might begin by playing a melancholy tune and then gradually transition to a mellower tune as it adjusts to its situation. On the other hand, if the device 50 wakes in an excited mood and fails to find a friend, then it might begin by playing a more frantic or impatient tune and then transition to a more varied repertoire as it adjusts to its situation. In addition to music, the device 50 may dance, move in other ways, or provide other output (e.g., lighting patterns) related to the music.

In step 211, upon finding another device with which to interact (e.g., a friend), the device 50 begins an interaction sequence with that of the device. Certain options in this regard are discussed in more detail below. Generally speaking, however, the two devices begin playing music together, with the particular musical selections and the way in which such music is played being determined jointly by the identification codes 102 of the two devices 50. In certain embodiments, the volume at which each individual device 50 plays is influenced by the distance to the device(s) with which it is playing; for instance, if further away, the volume increases, as if calling out to each other, and the volume decreases when they are closer.

In either event (i.e., whether step 209 or 211 was executed), at some point 213 a determination is made whether the device 50 should go back to sleep. For example, the device 50 might go back to sleep after a predetermined amount of waking time, after playing a predetermined number of songs, or when instructed to return to the sleep mode by the user. If it is time to return to sleep, then processing returns to step 202 in order to await the next time to awaken.

If not, then any of a variety of different activities might occur. For example, the device 50 might simply continue playing music in step 209 or 211, as applicable, or might engage in other activities, whether solo, interacting with other devices, or interacting with the user. Certain examples are described below. However, in the present embodiment, processing returns to step 205, signifying that the device 50 periodically broadcasts a call in order to attempt to identify other related or compatible devices.

Figure 7:
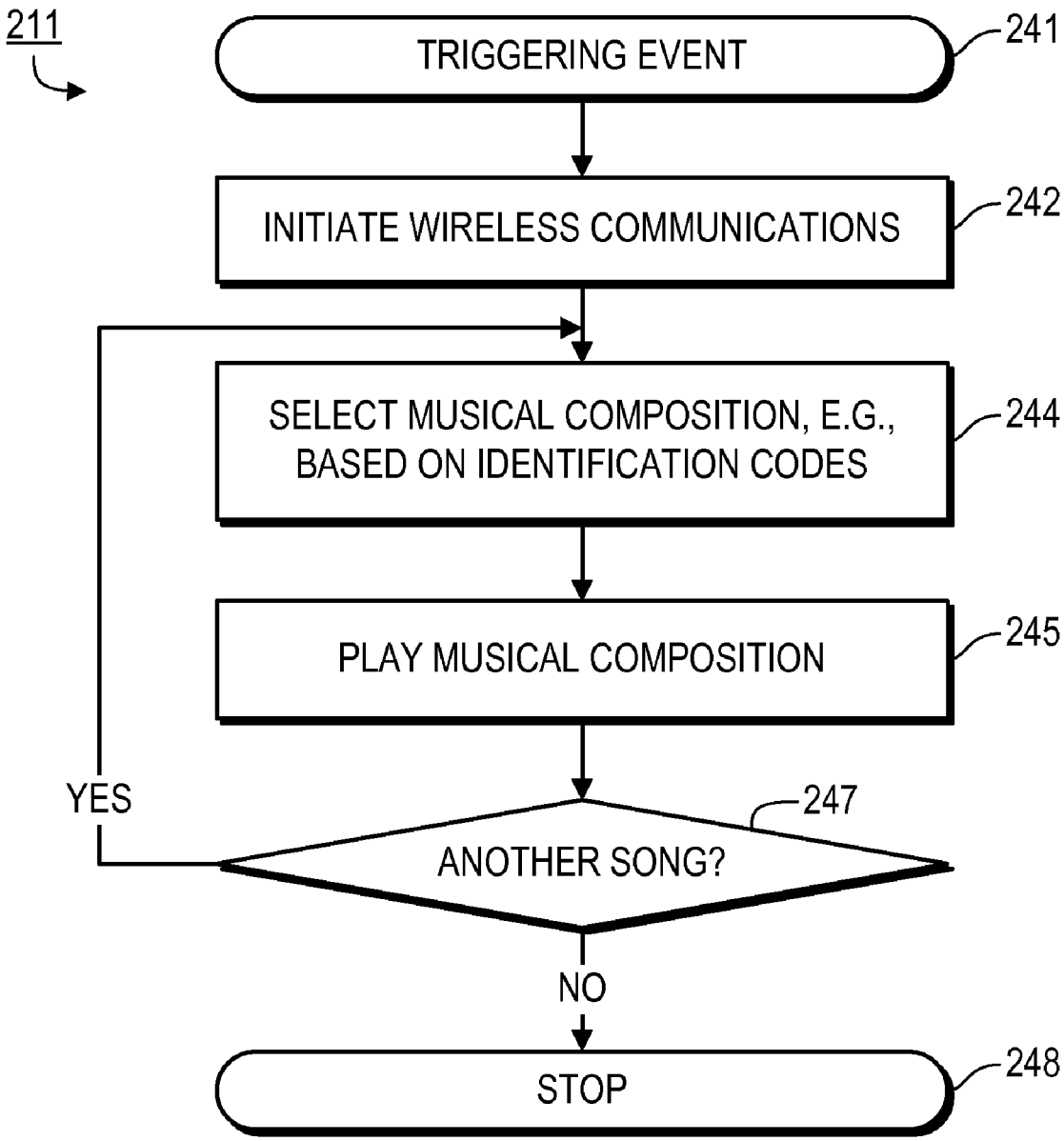
FIG. 7 is a flow diagram illustrating a general process by which to different devices may interact according to a representative embodiment of the present invention.

FIG. 7 is a flow diagram illustrating a general process 211 by which to different devices may interact according to a representative embodiment of the present invention. The steps shown in FIG. 7 preferably are implemented automatically using a combination of software residing on each of the participating devices (or in some cases, as described in more detail below, on a central hub) but in alternate embodiments is implemented in any of the other ways described herein.

Initially, in step 241 a triggering event occurs. This triggering event might be the two devices recognizing each other in step 207 (discussed above). Alternatively, one of the devices 50 might be broadcasting a request for a particular device (or friend) to which such device responds. Still further, a user might force a recognition by placing two devices in proximity to each other and initiating an interaction sequence.

In any event, in step 242 wireless communications occur, either directly between the two devices or, in certain cases as described below, through a central hub. Such communications might be part of the recognition sequence or might involve the transfer of one or more of the identification codes 102 from one device to the other. As discussed in more detail below, additional wireless communications often will occur throughout the interaction process 211.

Figure 8:
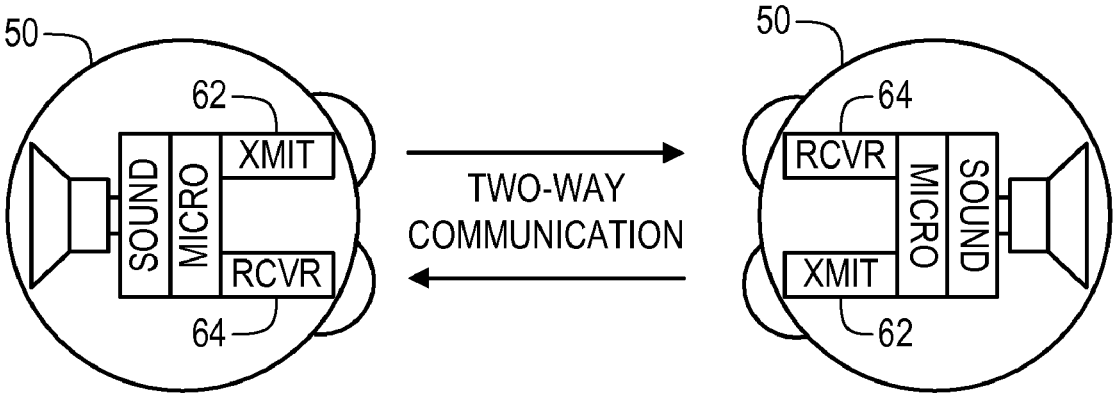
FIG. 8 is a block diagram illustrating direct wireless communication between two devices according to a representative embodiment of the present invention.

It is noted that the present invention contemplates multiple different kinds of wireless communications between devices 50. One such embodiment is illustrated in FIG. 8. Here, direct wireless communication takes place between two devices 50, i.e., from the transmitter 62 of each device 50 to the receiver 64 of the other device 50. In cases where only two devices 50 are communicating with each other, the two devices 50 can be placed directly across from each other, as shown in FIG. 8, and the communication can occur using infrared technology.

Figure 9:
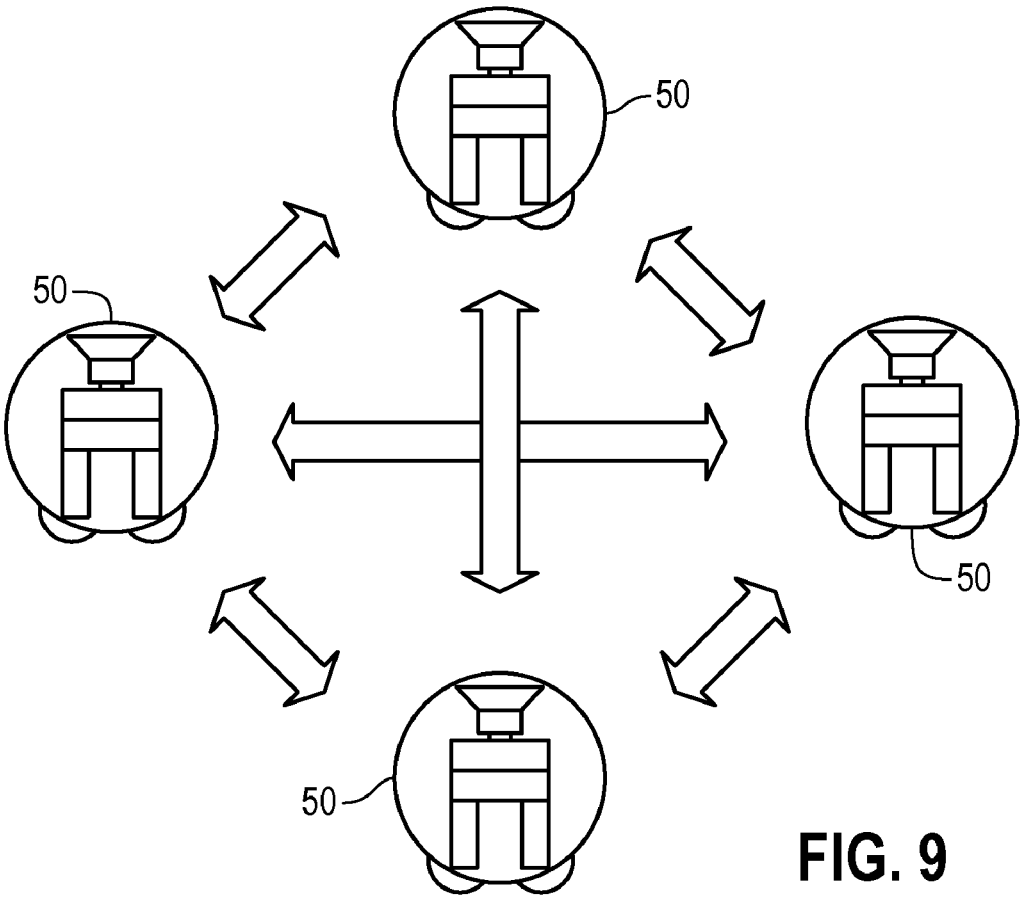
FIG. 9 is a block diagram illustrating direct wireless communication between multiple devices according to a representative embodiment of the present invention.

In an alternate embodiment, shown in FIG. 9, direct wireless communication occurs between multiple devices 50, i.e., from the transmitter 62 of each device 50 to the receiver 64 of each other device 50. Here, the communications occur on a peer-to-peer basis. Because multiple devices 50 are communicating with each other in this example, and/or in other cases where it is difficult for the devices to directly face each other, it is preferable to use a more flexible wireless technology, such as Bluetooth.

Figure 10:
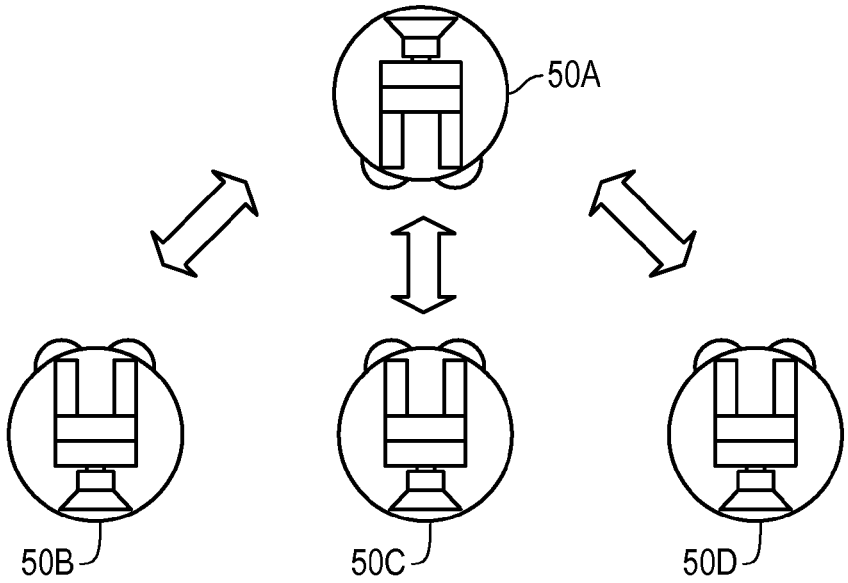
FIG. 10 is a block diagram illustrating direct wireless communication between multiple devices according to an alternate representative embodiment of the present invention.

FIG. 10 is a block diagram illustrating direct wireless communication between multiple devices 50 according to an alternate representative embodiment of the present invention. Here, one of the devices 50A is designated as the coordinator, such that it alone communicates with the other devices 50B-50D. One advantage of this configuration is that it often can work with directional wireless technologies, such as infrared. Another advantage is that the communication protocols often are simpler to implement than are peer-to-peer protocols.

Figure 11:
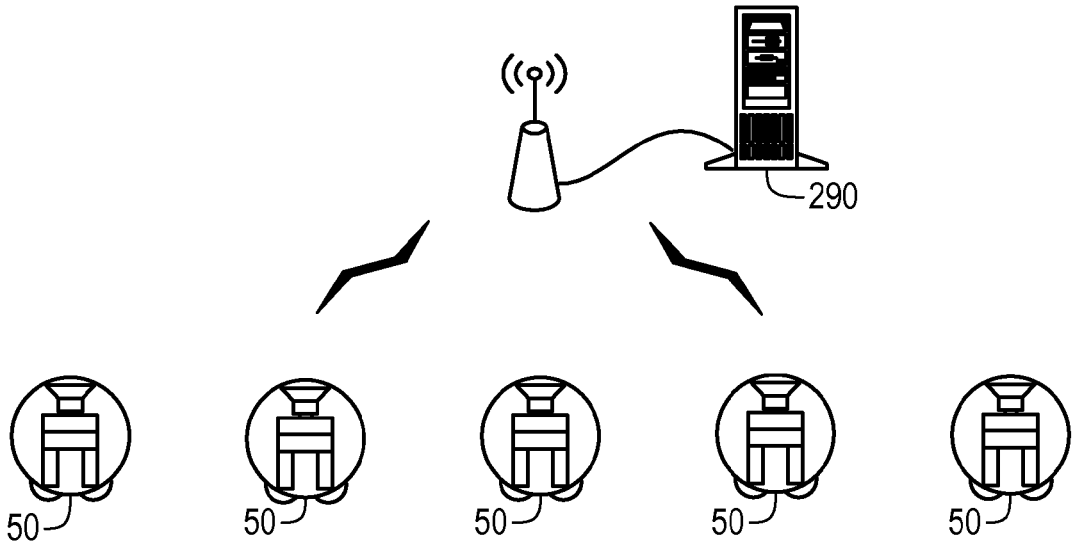
FIG. 11 is a block diagram illustrating wireless communication between multiple devices through a central hub, according to an alternate representative embodiment of the present invention.

In a still further embodiment, shown in FIG. 11, the individual devices 50 communicate to each other through a central hub 290 having compatible wireless communication capabilities. One advantage of this configuration is that much of the administrative functionality associated with coordinating the various devices 50 can be offloaded to the central hub, which typically will be larger and have a faster processor and more data storage capabilities. For example, central hub 290 may be implemented using a desktop, laptop or other general-purpose computer that has been loaded with software to enable it to coordinate communications among the devices 50, download musical segments as appropriate, and otherwise function as a central hub 290.

It is noted that different communication configurations can be used for different situations. For example, direct or peer-to-peer communications can be used where there is no central computer nearby, while a hub-based system is used when one is.

Returning to FIG. 7, in step 244 a musical composition is selected based on the identification codes 102 for the various devices 50 that have been linked (i.e., that are to participate). In the preferred embodiments, the selected composition is based on all of such identification codes 102, e.g., by finding a composition that corresponds to all of their musical styles. In one representative embodiment, each of the different devices 50 is configured to simulate the playing of a different musical instrument, and the musical composition is selected as one that has parts for all of the musical instruments present.

It is noted that a musical composition may be selected in whole from an existing music library (e.g., library 104) or may be selected by assembling it on-the-fly using appropriate musical segments within the library 104. In either case, either entire musical compositions or individual musical segments that make up compositions may have associated with them identification code values (or ranges of values) to which they correspond (e.g., which have been assigned by their composers). Accordingly, in one embodiment selecting an entire composition involves finding a composition that matches (or at least comes sufficiently close to) the identification code sets for all of the devices 50 that are linked. In another embodiment, a subset of musical segments is selected in a similar way, and then the individual segments are combined into a composition.

In this regard, how individual musical segments can be combined into a single composition preferably depends upon how the individual musical segments have been composed. For example, when composed using a simple chord set, it often will be possible to combine the musical segments and arbitrary (e.g., random) orders. In one embodiment, devices (e.g., toys) 50 are each pre-programmed with 8 bars of a tune which, when played together in sequence, constitute harmony and melody. In another embodiment, the 8 bars are shuffled randomly and can be played in any arbitrary sequence; when two such shuffled sequences are played together, they constitute a harmony and a melody; this preferably is accomplished by composing the music with a very simple use of chords.

In a more complicated embodiment, the individual segments within library 104 are labeled to indicate which other musical segments they can be played with and which other musical segments they can follow (or be followed by). In such a case, the various parts played by the different linked devices 50 are assembled in accordance with such rules, preferably using a certain amount of random selection to make each new musical composition unique.

In alternate embodiments the selection of musical composition is based on the identification codes 102 for fewer than all of the linked devices 50, in some cases, based on the identification code 102 for just one of such devices 50, and in other cases selected independently of any identification codes 102. As discussed in more detail below, the devices 50 preferably at least modify their play styles based on the musical composition to be played, as well as the identification codes 102 of the other linked devices 50.

In step 245, the musical composition is played by the participating devices 50 using the results from step 244. It is noted that step 244 can continue to be executed to provide future portions of the composition while the current portions are being played in step 245 (i.e., so that both steps are being performed simultaneously). One advantage of this approach is that it allows for adaptation of the composition based on new circumstances, e.g., the joining of a new device 50 while the composition is being played. In any event, one or more synchronization signals preferably are broadcast among the participating devices 50 when playing begins and then periodically throughout the composition so that the individual devices can correct any problems resulting from clock skew.

The participating devices 50 can cooperatively play a single composition in a number of different ways. For example, the devices 50 can all play in harmony or otherwise simultaneously. Alternatively, the devices 50 can play sequentially. For example, one device "wakes up" and sings "Happy . . . ", another device sings " . . . . Birthday . . . ", a third device sings " . . . To . . . ", a fourth device sings " . . . . You . . . " etc. Still further, any combination of these playing patterns can be incorporated when playing a single composition.

In step 247, a determination is made as to whether a new song is to be played. For example, in representative embodiments, after linking together, the devices 50 play a fixed number of songs (e.g., 1-3) before stopping. If another song is in fact to be played, then processing returns to step 244 to select (e.g., select in whole or assemble) the composition. If not, then processing stops, e.g., awaiting the next triggering event 241.

Figure 12:
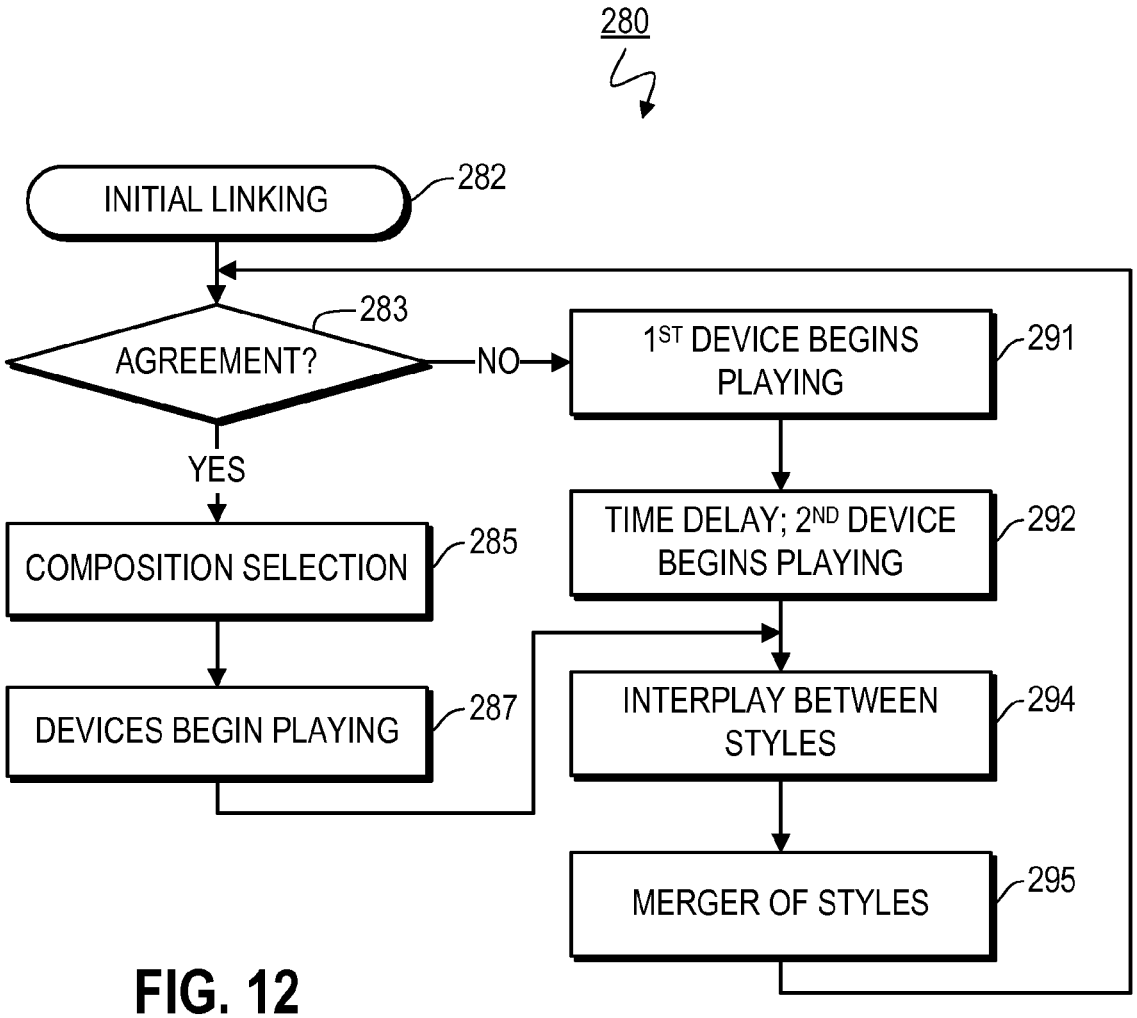
FIG. 12 is a flow diagram showing an interaction process between two devices according to a representative embodiment of the present invention.

FIG. 12 is a flow diagram showing an interaction process 280 between two devices 50 according to a representative embodiment of the present invention. Initially, in step 282 the two devices 50 find and identify each other.

Next, in step 283 a determination is made as to whether the devices 50 will agree to a composition. In the preferred embodiments, this decision is made based on circumstances (e.g., whether one of the devices 50 already was playing when the linking occurred in step 282), the identification codes 102 for the two devices 50 (e.g., one having a strong personality or being in an excited mood might begin playing without agreement from the other) and/or a random selection (e.g., in order to keep the interaction dynamics fresh). If agreement was reached in step 283, then a composition is selected in step 285 (e.g., based on both sets of identification codes 102), and the devices begin playing together in step 287.

On the other hand, if agreement was not reached, then in step 291 one of the devices 50 begins playing. After some time delay, in step 292 the other device 50 joins in. This approach simulates a variety of circumstances in which one musician listens to the other and then joins in when he or she identifies how to adapt his or her own style to the other's. At the same time, the delay provides additional lead time for generating the multi-part musical composition.

In either event, once the two devices 50 have begun playing together, in step 294 any of a variety of different musical interplays can occur between the two devices 50. For example, and as discussed in more detail below, each of the devices 50 preferably alternates between its own style and some blend of its style and that of the other's. At the same time, each of the devices 50 can take turns dominating the musical composition (and therefore reflecting more of its individual musical style) and/or the devices 50 can play more or less equally, either merging their styles or playing complementary lines of their individual styles. In addition, the musical composition preferably varies between segments where the devices 50 are playing together (e.g., different lines in harmony) and where they are playing sequentially (e.g., alternating portions of the same line, but where each is playing according to its own individual style).

Eventually, in step 295 the two styles merge closer together. That is, the amount of variance between the two devices 50 tends to decrease over time as they get used to playing with each other. Upon completion of the current musical composition, processing returns to step 283 to repeat the process. In this way, a number of different compositions can be played with a nearly infinite number of variations, thereby simulating actual musical interaction. Moreover, with an appropriate amount of randomness introduced into the system, a sense of spontaneity often can be maintained.

It is noted that the foregoing example describes just one way in which two devices 50 interact with each other. All of the various concepts discussed herein can be implemented in different combinations to achieve different playing patterns. Also, the foregoing examples primarily focus on interactions between two devices 50. However, any number of devices 50 may interact with each other in any of the ways described herein.

Figure 13:
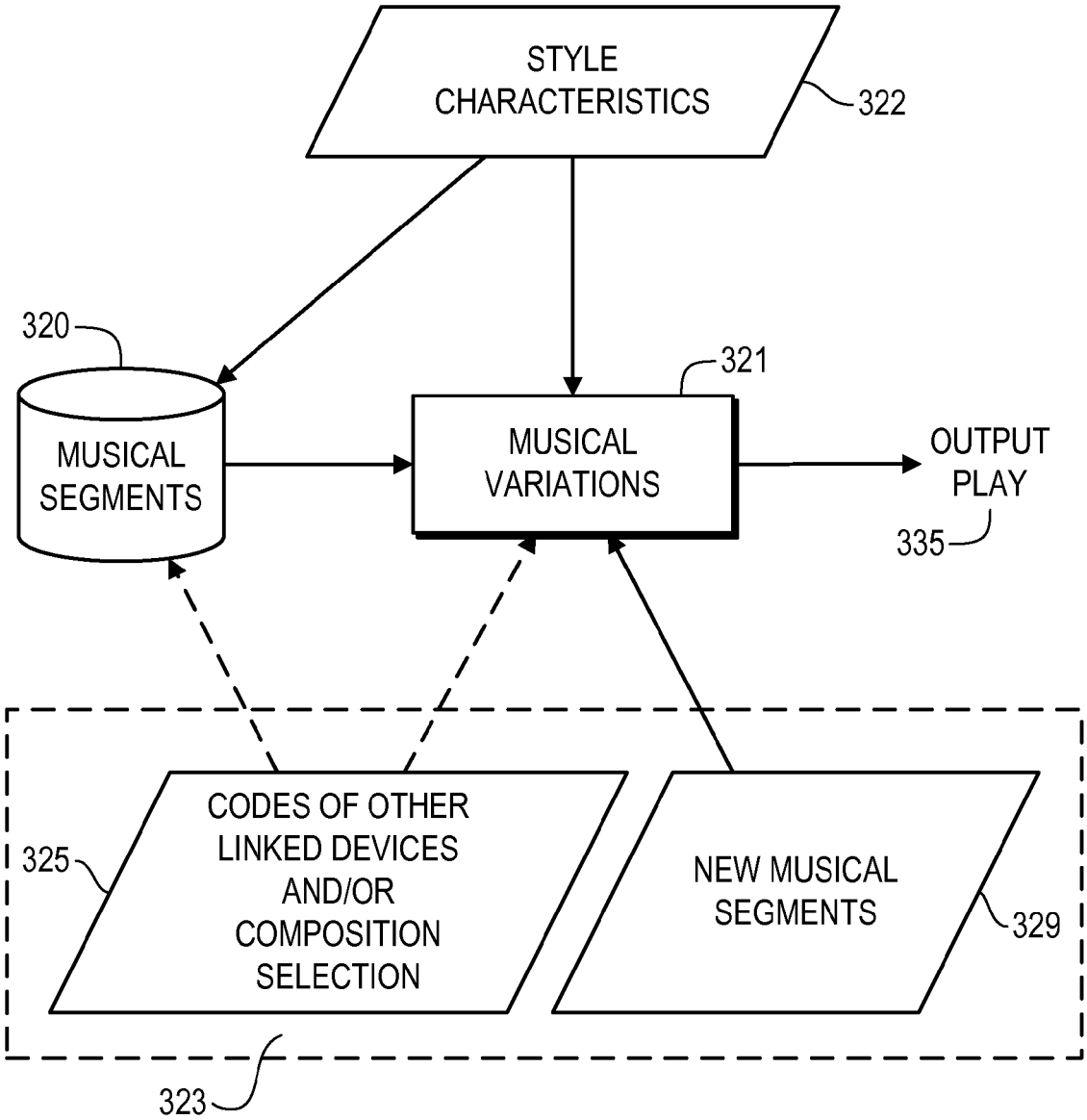
FIG. 13 illustrates a block diagram of a process for an individual device to produce music according to a representative embodiment of the present invention.

FIG. 13 illustrates a block diagram of a process for an individual device 50 to produce music according to a representative embodiment of the present invention. Generally speaking, there are two main components to the musical generation process. First, musical segments are selected, typically from a database 320 (such as internal musical library 104) and then play patterns are selected 321, determining the final form of the music 335 that is output.

The selection of the musical segments preferably depends upon a number of factors, including the style characteristics 322 of the subject device 50 and other information 323 that has been input from external sources (e.g., via the wireless transmitter 62 and receiver 64). One category of such information 323 potentially includes information 325 regarding the identification codes 102 of the other devices 50 that are linked to the current device 50 and/or regarding the musical composition that has been selected. As noted above, different musical segments (e.g. entire compositions or portions thereof) may be selected depending upon the nature of the other linked devices 50.

For this purpose, stored musical segments preferably have associated metadata that indicate other musical segments to which they correspond. In addition, in certain embodiments, the stored musical segments have a set of scores indicating the musical styles to which they correspond. At the same time, in certain embodiments the devices 50 also have a set of scores indicating the amount of musical influence each genre has had on it. Thus, for example, if the current device 50 is playing with another device that has a strong country music style or influence (e.g., a high code value in the country music category), then the current device 50 is more likely to select segments that have higher country music scores (i.e., higher code values in the country music category). Similarly, if the base composition already has been selected (e.g., without input from the current device 50), then the segments selected by the current device 50 preferably are matched to that composition, in terms of style, harmony, etc.

As to the selection of musical variations 321, it is noted that each musical segment preferably can be played in a variety of different ways. For example, some of the properties that may be modified preferably include overall volume (which can be increased or decreased), range of volume (which can be expanded so that certain portions are emphasized more than others or compressed so that the segment is played with a more even expression), key (which can be adjusted as desired) and tempo (which can be sped up or slow down). Generally speaking, the key and tempo are set so as to match the rest of the overall musical composition. However, the other properties may be adjusted based on the existing circumstances.

Once again, the adjustment of such properties preferably depends upon the style characteristics 322 of the subject device 50 as well as information 325 regarding the identification codes 102 of the other devices 50 that are linked to the current device 50 and/or regarding the musical composition that has been selected. In addition, new musical segments 329 may be provided from outside sources that may be incorporated into the overall music 335 that is output on the subject device 50. In one example, one of the linked devices 50 that has a country music style provides the subject device 50 (e.g., via the wireless transmitter 62 and receiver 64) with a set of country music segments that can be incorporated into its musical output 335. In this particular case, such new musical segments 329 are only used in the current session. However, in alternate embodiments, one or more of such new musical segments 329 are stored into the music database 320 for the current device 50, so that they can also be used in future playing sessions.

Figure 14:
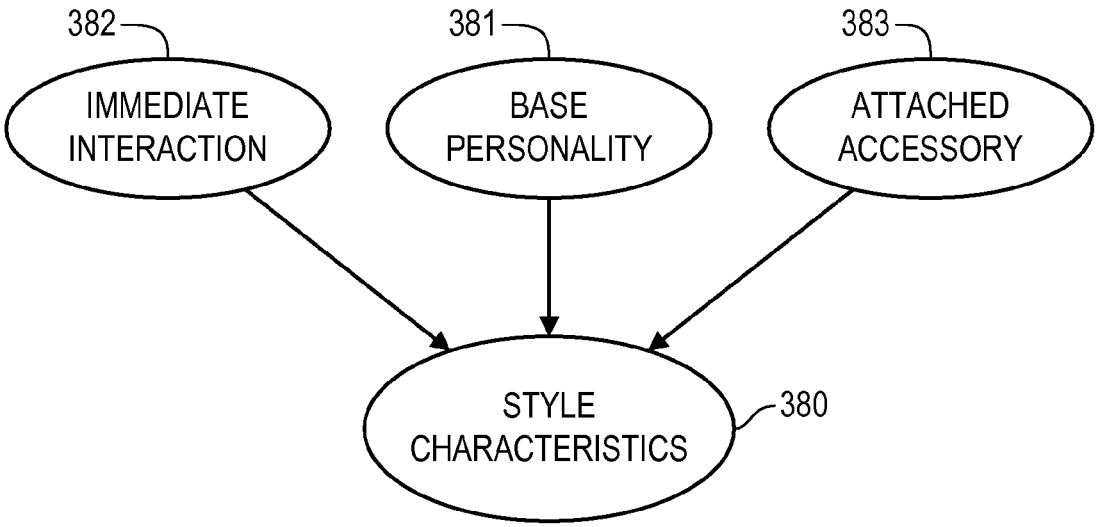
FIG. 14 illustrates a block diagram showing the makeup of a current music-playing style according to representative embodiment of the present invention.

FIG. 14 illustrates a block diagram showing the makeup of a current music-playing style 380 according to representative embodiment of the present invention. As noted above, several different considerations influence how a particular device 50 plays music in the preferred embodiments of the invention.

One of those considerations is the base personality 381 of the device 50, i.e., the entire set of identification codes 102 for the device 50. For example, the codes 102 might include a score for each of a number of different musical genres (e.g., country, 50s rock, 60s folk music, 70s rock, 80s rock, disco, reggae, classical, hip-hop, country-rock crossover, hard rock, progressive rock, new age, Gospel, jazz, blues, soft rock, bluegrass, children's music, show tunes, Opera, etc.), a score for each different cultural influence (e.g., Brazilian, African, Celtic, etc.) and a score for different personality types (e.g., boisterous or laid-back). As discussed below, the base personality codes 381 preferably remain relatively constant but do change somewhat over time. In addition, the user preferably has the ability to make relatively sudden changes to the base personality codes 381, e.g., by modifying such characteristics via port 74.

Another factor that preferably affects current playing style 380 is the current interaction in which the device 50 is engaging. That is, the device 50 preferably is immediately influenced by the other devices 50 with which it is playing.

Figure 15:
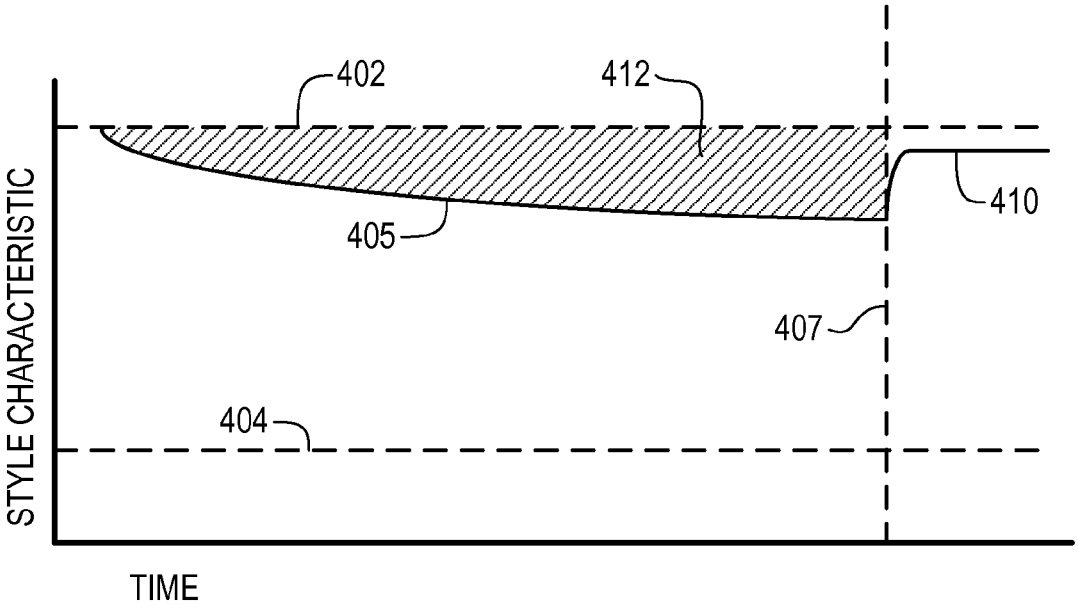
FIG. 15 illustrates a timeline showing how a personality code can change over time due to an immediate interaction, according to a representative embodiment of the present invention.

An example is shown in FIG. 15, which illustrates how a single style characteristic (or identification code 102) can vary over time based on an interaction with a single other device 50. The current device 50 has an initial value of a particular style characteristic (say, boisterousness) indicated by line 402, and the device with which it is playing has an initial value indicated by line 404. After some period of time playing together, the value of the characteristic moves 405 closer to the value 404 for the device 50 with which it is playing (e.g., its style of play becomes more relaxed or mellow). When the session ends 407 so that the two devices are no longer playing together, the characteristic value returns to a value 410 that is close, but not identical, to its original value 402, indicating that the experience of playing with the other device has had some lasting impact on the current device 50.

While this example is for a single characteristic value, a number of characteristic values can change in this manner over time. As a result, the individual devices 50 can learn and evolve, potentially acquiring new musical segments at the same time. Due to this capability, as well as the preferred randomness built into the selection of musical segments and the musical variations 321 applied to them, the interactions between any two devices 50 often will be different. Also, although the value for only one of the devices 50 is shown as changing in FIG. 15, in the preferred embodiments both values would be moving closer toward each other. Still further, although the change is shown as being smooth and gradual, in the preferred embodiments variations occur within the entire space 412 (either in a predetermined or random manner) so as to simulate real-life learning processes.

Preferably, the entire timeline shown in FIG. 15 occurs over a period of minutes or tens of minutes. It is noted that the personality code preferably comes closer to but does not become identical with the corresponding code for the device with which the current device 50 is playing, even if the two grew to play together indefinitely. That is, a base personality code 381 preferably is the dominant factor and can only be changed within a single interaction session to a certain extent (which extent itself might be governed by another personality code, e.g., one designated "openness to change").

Returning to FIG. 14, another factor potentially affecting the current style characteristics 380 is the addition of a modular component 383, such as an accessory that is pre-loaded with a music library and associated characteristics for a particular music genre. For example, the addition of a cowboy hat having an embedded chip with country music and associated country-music codes preferably results in an instant style fusion between the base personality (and style) codes 381 and the added codes 383.

In addition to the other identification and personality codes 102 discussed herein, the codes 102 counts of include unique relationship codes, expressing the state of the relationship between two specific devices 50. Such codes indicate how far along in relationship the two devices 50 are (e.g., whether they just met or are far along in the relationship), as well as the nature of the relationship (e.g., friends or in-love). As result, the relationships between devices can vary, not only based on time and experience, but also based on the nature and length of relationships.

One aspect of the present invention is the identification of another device (e.g., toy) that is the current toy's soul mate. In such a case, embedded codes can identify two toys that should be paired and, when they come in contact with each other, engage in an entirely different manner than any other pair of toys. Alternatively, toys merely can be designated as compatible with each other, so the two compatible toys can develop a love relationship given enough time together. Still further, any combination of these approaches can be employed.

Figure 16:
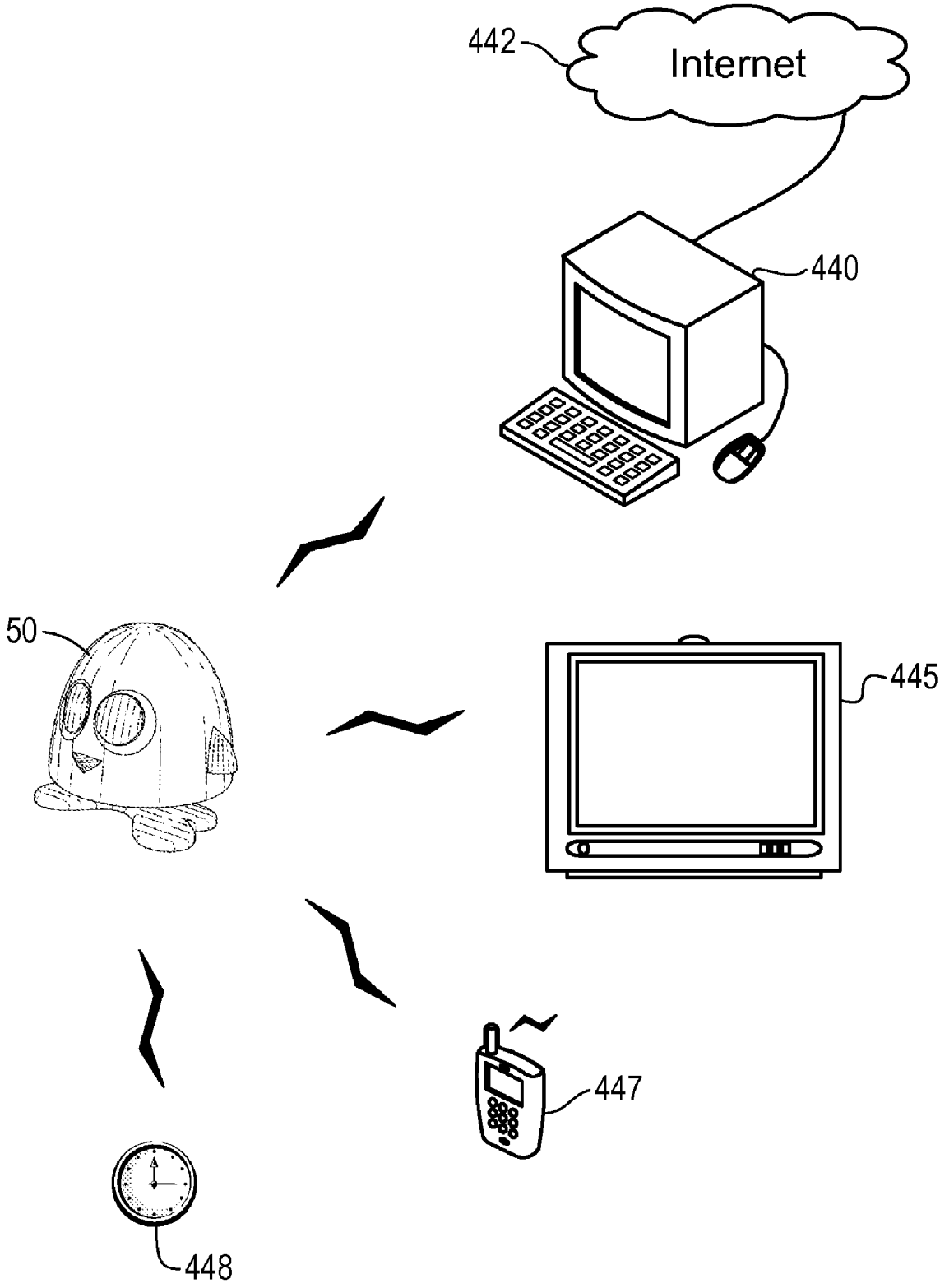
FIG. 16 is a block diagram illustrating communications between an interactive device and a variety of other devices according to a representative embodiment of the present invention.

In addition to similar devices (or toys) 50 communicating with each other, the present invention contemplates communications with a wide variety of other kinds of devices, for a wide variety of other purposes. Examples are illustrated in FIG. 16. In each case, the connections may be made wirelessly or via hard-wired connections, although wireless connections (e.g., Bluetooth) generally are preferred.

A connection with a general-purpose computer 440 generally can allow new information and configuration settings to be easily downloaded into the device 50. In addition, if the general-purpose computer 440 is connected to the Internet 442 or another publicly accessible network, then a great deal of additional information can be provided to device 50. For example, seasonal music can be automatically downloaded to device 50 at the appropriate times of year. In addition, if a user's configuration (e.g., input via computer 440) indicates that he or she is a fan of a particular sports team, when that team has won a game a signal can be provided to device 50 to play a victory song. In a similar way, current information regarding other news, weather, calendar events or the like can be provided to device 50, potentially with new music downloads related to the information.

In addition, the connection to a general-purpose computer 440 permits a variety of additional interactive behaviors. For instance, a computer program or Internet web site (e.g., executing a Java application) can instruct transmission of information to device 50, causing device 50 to interact with something that is occurring on the display screen for the computer 440 and/or that is synchronized with the audio game played by computer 440. As a result, the device 50 appears to participate (e.g., musically, by speaking words or by moving) in a scripted show or event that is occurring on the computer 440.

Also, by providing an interface to a communications network, such as the Internet 442, computer 440 also enables device 50 to communicate over long distances. Thus, for example, the wireless signals that ordinarily would be used to communicate locally can be picked up by computer 440, transferred over the network 442, and delivered to another device 50 at the other end. In this way, two devices 50 can play music together or otherwise communicate with each other over long distances, e.g., with the audio from the remote device 50 being played over the speaker of the computer 440. The software for communicating with device 50 can be provided, e.g., on computer 440 and/or on a remote computer at the other end of the connection over network 442.

The foregoing techniques can be used with other kinds of external devices as well. For example, using a connection between device 50 and a television set 445, device 50 can be made interactive with programming being displayed on television 445. In such a case, the signal received by television 445 preferably includes information instructing how and when (relative to the subject programming) device 50 should make certain sounds or perform certain actions.

Using a connection (e.g., a Bluetooth connection) to a wireless telephone 447, a device 50 according to the present invention can communicate across a cellular wireless network, e.g., in a similar manner to that described above with respect to communications across the Internet 442.

Also, other networked devices and appliances can be used to provide information regarding the environment the device 50. For example, a clock 448 provided with an appropriate communication interface can provide information regarding the time of day (e.g., for the purpose of waking device 50). Of course, a general-purpose computer 440 also could provide such information to device 50. There is other kinds of devices (not shown) to provide positional information (indicating to device 50 where it is within its environment) or any of the desired information.

Although the foregoing description primarily focuses on the ability of the devices 50 to make music, in certain embodiments they also (or instead) are configured to output speech. For example, different devices 50 may speak to each other so as to simulate a conversation. Alternatively, speech may be combined with music in any of a variety of different ways.

In addition to the other capabilities described above, a device 50 may be provided with the ability to record a user's speech and play it back even identically or in some modified form. For example, the user's speech may be played back according to a stored rhythm or tune (e.g., by modifying the pitch of the spoken or sung words). Still further, the user's words may be repeated back with a particular twist, such as by speaking them backwards.

System Environment.

Generally speaking, except where clearly indicated otherwise, all of the systems, methods and techniques described herein can be practiced with the use of one or more programmable general-purpose computing devices. Such devices typically will include, for example, at least some of the following components interconnected with each other, e.g., via a common bus: one or more central processing units (CPUs); read-only memory (ROM); random access memory (RAM); input/output software and circuitry for interfacing with other devices (e.g., using a hardwired connection, such as a serial port, a parallel port, a USB connection or a firewire connection, or using a wireless protocol, such as Bluetooth or a 802.11 protocol); software and circuitry for connecting to one or more networks (e.g., using a hardwired connection such as an Ethernet card or a wireless protocol, such as code division multiple access (CDMA), global system for mobile communications (GSM), Bluetooth, a 802.11 protocol, or any other cellular-based or non-cellular-based system), which networks, in turn, in many embodiments of the invention, connect to the Internet or to any other networks); a display (such as a cathode ray tube display, a liquid crystal display, an organic light-emitting display, a polymeric light-emitting display or any other thin-film display); other output devices (such as one or more speakers, a headphone set and a printer); one or more input devices (such as a mouse, touchpad, tablet, touch-sensitive display or other pointing device, a keyboard, a keypad, a microphone and a scanner); a mass storage unit (such as a hard disk drive); a real-time clock; a removable storage read/write device (such as for reading from and writing to RAM, a magnetic disk, a magnetic tape, an opto-magnetic disk, an optical disk, or the like); and a modem (e.g., for sending faxes or for connecting to the Internet or to any other computer network via a dial-up connection). In operation, the process steps to implement the above methods and functionality, to the extent performed by such a general-purpose computer, typically initially are stored in mass storage (e.g., the hard disk), are downloaded into RAM and then are executed by the CPU out of RAM. However, in some cases the process steps initially are stored in RAM or ROM.

Suitable devices for use in implementing the present invention may be obtained from various vendors. In the various embodiments, different types of devices are used depending upon the size and complexity of the tasks. Suitable devices include mainframe computers, multiprocessor computers, workstations, personal computers, and even smaller computers such as PDAs, wireless telephones or any other appliance or device, whether stand-alone, hard-wired into a network or wirelessly connected to a network.

In addition, although general-purpose programmable devices have been described above, in alternate embodiments one or more special-purpose processors or computers instead (or in addition) are used. In general, it should be noted that, except as expressly noted otherwise, any of the functionality described above can be implemented in software, hardware, firmware or any combination of these, with the particular implementation being selected based on known engineering tradeoffs. More specifically, where the functionality described above is implemented in a fixed, predetermined or logical manner, it can be accomplished through programming (e.g., software or firmware), an appropriate arrangement of logic components (hardware) or any combination of the two, as will be readily appreciated by those skilled in the art.

It should be understood that the present invention also relates to machine-readable media on which are stored program instructions for performing the methods and functionality of this invention. Such media include, by way of example, magnetic disks, magnetic tape, optically readable media such as CD ROMs and DVD ROMs, or semiconductor memory such as PCMCIA cards, various types of memory cards, USB memory devices, etc. In each case, the medium may take the form of a portable item such as a miniature disk drive or a small disk, diskette, cassette, cartridge, card, stick etc., or it may take the form of a relatively larger or immobile item such as a hard disk drive, ROM or RAM provided in a computer or other device.

The foregoing description primarily emphasizes electronic computers and devices. However, it should be understood that any other computing or other type of device instead may be used, such as a device utilizing any combination of electronic, optical, biological and chemical processing.

Additional Considerations.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A system of musically interacting devices, comprising:

a first device having a first identification code, a first wireless communication interface and a first audio player; and a second device having a second identification code, a second wireless communication interface and a second audio player, wherein the first device and the second device are configured to participate in an interaction sequence in which:

the first device wirelessly communicates using the first wireless communication interface and the second device wirelessly communicates using the second wireless communication interface, a musical composition is selected based on both the first identification code and the second identification code, and the first device and the second device cooperatively play the musical composition, with each of the first device and the second device playing a different part of the musical composition, wherein at least one device from among the first device and the second device is disposed within a housing that has an overall outward appearance of a toy character, and wherein said at least one device has attached to it a removable module that: (1) stores information causing a modification of the identification code of said at least one device, and (2) has an outward appearance indicating said modification.

2. A system according to claim 1, wherein the interaction sequence occurs automatically when the first device and the second device are positioned so that they are able to wirelessly communicate with the each other.

3. A system according to claim 1, further comprising a third device, having a third identification code, a third wireless communication interface and a third audio player, and wherein the third device also is configured to participate in the interaction sequence, such that a musical composition is selected based on the first identification code, the second identification code and the third identification code, and all three devices cooperatively play the musical composition, with each of the first device, the second device and the third device playing a different part of the musical composition.

4. A system according to claim 1, wherein each of the first device and the second device is configured to replicate a sound of a different musical instrument.

5. A system according to claim 1, wherein at least one of the first device and the second device also is configured to play music independently.

6. A system according to claim 1, wherein the part of the musical composition played by the first device is based on the first identification code and the part of the musical composition played by the second device is based on the second identification code.

7. A system according to claim 1, further comprising an external device configured to load configuration information into at least one of the first device and the second device.

8. A system according to claim 1, further comprising an electronic link between a publicly accessible network and at least one of the first device and the second device, allowing said at least one of the first device and the second device to directly communicate across the publicly accessible network.

9. A system of musically interacting devices, comprising:

a first device having a stored first library of musical segments according to a first musical style, a first wireless communication interface and a first audio player; and a second device having a stored second library of musical segments according to a second musical style, a second wireless communication interface and a second audio player, wherein the first device and the second device are configured to participate in an interaction sequence in which:

the first device wirelessly communicates using the first wireless communication interface and the second device wirelessly communicates using the second wireless communication interface, a musical composition is selected based on the first musical style, the first device plays the musical composition, and the second device plays accompanying music to the musical composition, the accompanying music being based on the second musical style and at least one of: (1) the first musical style and (2) the musical composition, wherein at least one device from among the first device and the second device is disposed within a housing that has an overall outward appearance of a toy character, and wherein said at least one device has attached to it a removable module that: (1) stores information causing a modification of the musical style of said at least one device, and (2) has an outward appearance indicating said modification.

10. A system according to claim 9, wherein in playing the accompanying music, the second device modifies existing musical segments based on at least one of: (1) the first musical style and (2) the musical composition.

11. A system according to claim 9, wherein in playing the accompanying music, the second device modifies existing musical segments based on the second musical style.

12. A system according to claim 9, wherein the interaction sequence occurs automatically when the first device and the second device are positioned so that they are able to wirelessly communicate with the each other.

13. A system according to claim 9, wherein at least one of the first device and the second device also is configured to play music independently.

14. A system according to claim 9, further comprising an electronic link between a publicly accessible network and at least one of the first device and the second device, allowing said at least one of the first device and the second device to directly communicate across the publicly accessible network.

15. A system of musically interacting devices, comprising:

a plurality of different devices, each having an associated identification code and each storing a plurality of musical patterns related to its identification code, wherein upon linking individual ones of the different devices together, the linked devices execute an interaction sequence in which they play a musical composition, with different ones of the linked devices playing different parts of the musical composition, wherein the musical composition is based on the associated identification codes of the linked devices, wherein at least one device from among the different devices is disposed within a housing that has an overall outward appearance of a toy character, and wherein said at least one device has attached to it a removable module that: (1) stores information causing a modification of the identification code of said at least one device, and (2) has an outward appearance indicating said modification.

16. A system according to claim 15, wherein arbitrary combinations of the different devices can be linked together.

17. A system according to claim 15, wherein the interaction sequence occurs automatically when the first device and the second device are positioned so that they are able to wirelessly communicate with the each other.

* * * * *